US006052834A

United States Patent [19]

Chou

[11] Patent Number: 6,052,834

[45] Date of Patent: Apr. 25, 2000

[54] PADDING DEVICES FOR SWIMMING GOGGLES

[76] Inventor: Terry Chou, No. 12, Hsin Ho Herng Road, Tainan City, Taiwan

[21] Appl. No.: 09/325,228

[22] Filed: Jun. 3, 1999

[30] Foreign Application Priority Data

Dec. 24, 1998 [TW] Taiwan ..... 87221487

[51] Int. Cl.[7] ..... A61F 9/02

[52] U.S. Cl. ..... 2/428; 2/426; 2/440; 2/445

[58] Field of Search ..... 2/426, 427, 428, 2/430, 431, 432, 435, 439, 440, 442, 444, 445, 446

[56] References Cited

U.S. PATENT DOCUMENTS

| | | | |
|---|---|---|---|
| 5,603,125 | 2/1997 | Chou | 2/428 |
| 5,890,237 | 4/1999 | Herman | 2/440 |
| 5,894,606 | 4/1999 | Chiang | 2/440 |
| 5,896,588 | 4/1999 | Chiang | 2/428 |
| 5,896,589 | 4/1999 | Chou | 2/428 |
| 5,950,248 | 9/1999 | Kawashima et al. | 2/441 |

*Primary Examiner*—John J. Calvert
*Assistant Examiner*—Katherine Moran
*Attorney, Agent, or Firm*—Charles E. Baxley, Esq.

[57] ABSTRACT

A padding device is provided for a pair of swimming goggles. The padding device includes a connecting portion connected to a lens of the pair of the swimming goggles. An elastic annular extension extends inwardly from an inner wall of the connecting portion. A flange extends from the elastic annular extension to thereby define an annular groove between the inner wall of the connecting portion, the annular extension, and the flange. The flange provides a close contact with an eye socket of a user. A plastic protective ring is received in the annular groove for preventing the flange from being contacted with a rigid portion of the pair of swimming goggles.

13 Claims, 8 Drawing Sheets

PADDING DEVICES FOR SWIMMING GOGGLES

BACKGROUND OF THE INVENTION

1. Field of the Invention

The present invention relates to padding devices for swimming goggles with improved wearing comfort.

2. Description of the Related Art

FIGS. 8 and 9 of the drawings illustrate a pair of typical swimming goggles that includes two lenses 1', two padding members 2', a bridge 3', and a strap 4'. Each lens 1' is made of rigid material and includes an inner connecting section 11' for connecting with the bridge 3', an outer connecting section 12' for connecting with the strap 4', and a flange 13' for connecting with the padding member 2'. Each padding member 2' includes a connecting portion 21' for receiving the lens 1'. As shown in FIG. 10, an elastic annular extension 22' extends inwardly from an inner wall of the connecting portion 21' and then extends upwardly to form a flange 23' that provides a close contact with an eye socket of the user. Nevertheless, as shown in FIGS. 11 and 12, when the strap 4' is tightened, although the end edge "a" (FIG. 11) of the flange 23' is in a close contact with the eye socket of the user due to elasticity of the elastic extension 22', a portion "b" of the flange 23' might directly bear against the connecting portion 21' and a corner area "c" of the rigid flange 13'. This is because different users have different eye socket contours and thus causes different deformation in the annular extension 22'. As a result, the wearing comfort is adversely affected. A solution to this problem by increasing the thickness of the extension 22' to reduce the deformation thereof is found unsuccessful and brings an additional disadvantage of reduction in the wearing comfort provided by the padding member 2' as well as reduction in the softness of the extension 22'.

The present invention is intended to provide padding devices that mitigate and/or obviate the above problems.

SUMMARY OF THE INVENTION

In accordance with a first aspect of the invention, a padding device is provided for a pair of swimming goggles. The padding device comprises:

- a connecting portion adapted to be connected to a lens of the pair of the swimming goggles, the connecting portion including an inner wall;
- an elastic annular extension extended inwardly from the inner wall of the connecting portion;
- a flange extended from the elastic annular extension to thereby define an annular groove between the inner wall of the connecting portion, the annular extension, and the flange, the flange being adapted to be in a close contact with an eye socket of a user; and
- a plastic protective ring received in the annular groove for preventing the flange from being contacted with a rigid portion of the pair of swimming goggles.

In accordance with a second aspect of the invention, a padding device is provided for a pair of swimming goggles having a goggle frame with an inner wall. The padding device comprises:

- an elastic annular extension extended inwardly from the inner wall of the goggle frame;
- a flange extended from the elastic annular extension to thereby define an annular groove between the inner wall of the goggle frame, the annular extension, and the flange, the flange being adapted to be in a close contact with an eye socket of a user; and
- a plastic protective ring received in the annular groove for preventing the flange from being contacted with a rigid portion of the pair of swimming goggles.

The plastic protective ring may be solid or made of foam material. In addition, the plastic protective ring may be hollow and filled with gas or fluid to have a pressure, thereby providing a padding effect and/or buoyancy.

In accordance with a third aspect of the invention, a padding device is provided for a pair of swimming goggles. The padding device comprises:

- a connecting portion adapted to be connected to a lens of the pair of the swimming goggles, the connecting portion including an inner wall;
- an elastic annular extension extended inwardly from the inner wall of the connecting portion;
- a flange extended from the elastic annular extension, the flange being adapted to be in a close contact with an eye socket of a user; and
- an annular arcuate section extended between the inner wall of the connecting portion and the flange to thereby define a closed annular space among the inner wall of the connecting portion, the annular extension, the flange, and the annular arcuate section.

The closed annular space may be filled with gas or fluid to have a pressure, thereby providing a padding effect and/or buoyancy.

The padding devices in accordance with the present invention may provide improved wearing comfort and watertight effect regardless of the contour of the eye socket of the user. The rigid end edge of the lens is not directly contacted with the flange of the padding device due to provision of the plastic protective ring. In addition, the padding device with gas or fluid filled therein may have buoyancy such that the pair of swimming goggles may float on the water to thereby avoid loss of the pair of swimming goggles.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
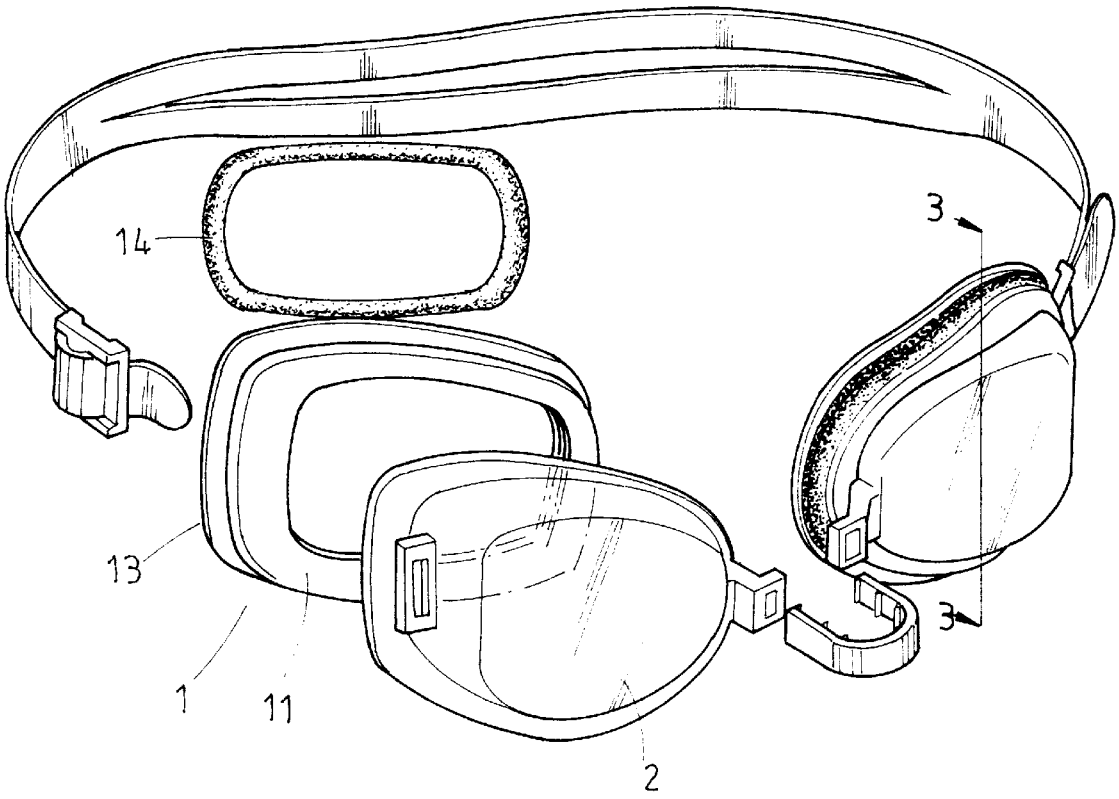
FIG. 1 is a perspective view, partly exploded, of a pair of swimming goggles with a first embodiment of a padding device in accordance with the present invention.
Figure 2:
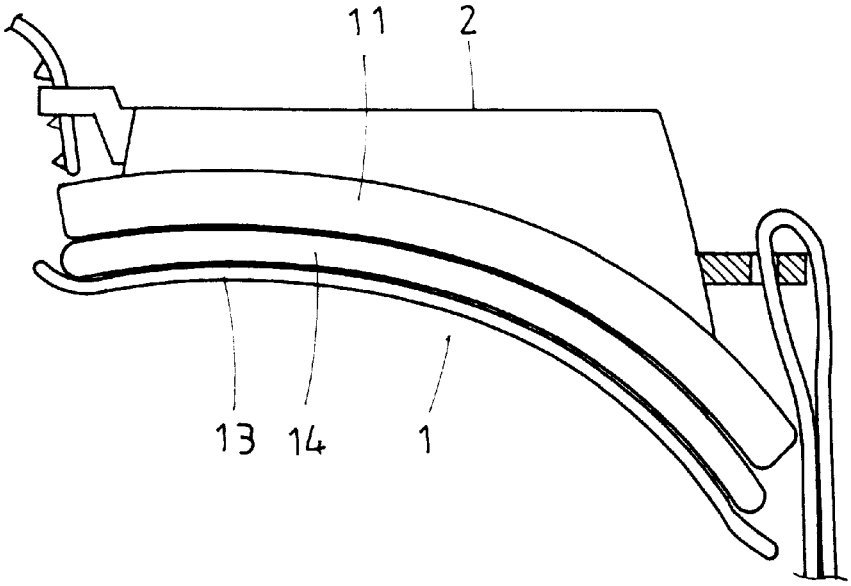
FIG. 2 is a partial top view of the pair of swimming goggles in FIG. 1.
Figure 3:
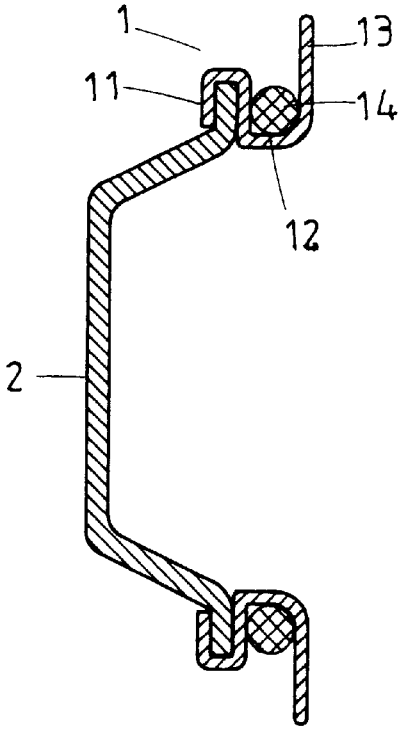
FIG. 3 is a sectional view taken along line 3—3 in FIG. 1.

Referring to FIGS. 1 and 2, a pair of swimming goggles in accordance with the present invention includes two lenses 2, two padding devices 1, a bridge (not labeled), and a strap (not labeled). The padding device 1 includes a connecting portion 11 for receiving the lens 2. As shown in FIG. 3, an elastic annular extension 12 extends inwardly from an inner wall of the connecting portion 11 and then extends upwardly to form a flange 13 that provides a close contact with an eye socket of the user. A protective ring 14 of plastic material (e.g., foam material) is received in an annular groove defined between the inner wall of the connecting portion 11, the annular extension 12, and the flange 13.

Figure 4:
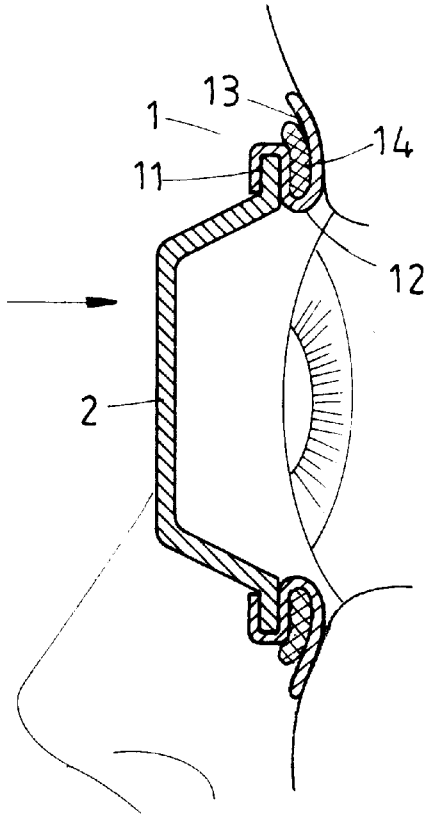
FIG. 4 is a schematic sectional view similar to FIG. 3, illustrating use of the swimming goggles.

By such an arrangement, when the strap is tightened during use, as shown in FIG. 4, the padding device 1 is in a close contact with the eye socket of the user. As can be seen from FIG. 4, the flange 13 is in a close contact with the eye socket regardless of the contour of the eye socket to thereby prevent ambient water from entering the eye socket. In addition, the flange 13, when subjected to a force and thus moves outward, bears against the plastic protective ring 14 rather than the end edge of the rigid lens 2. Thus, an improved wearing comfort is provided.

Figure 5:
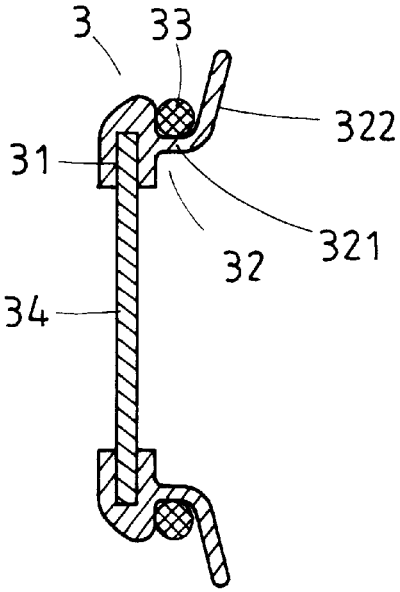
FIG. 5 is a sectional view of a second embodiment of the padding device in accordance with the present invention.

FIG. 5 shows another embodiment of the invention, wherein the goggle frame 3 is made of soft material and includes a lip or connecting portion 31 that is bonded with a rigid lens 34 by means of ultrasonic working or other suitable means. A padding device 32 is directly formed on an inner side of the goggle frame 3. The padding device 32 includes an annular extension 321 that extends from an inner wall of the goggle frame 3 and a flange 322 extends upwardly and outwardly from a peripheral end edge of the annular extension 321. A protective ring 33 of plastic material is received in an annular groove defined between the inner wall of the goggle frame 3, the annular extension 321, and the flange 322.

Figure 6:
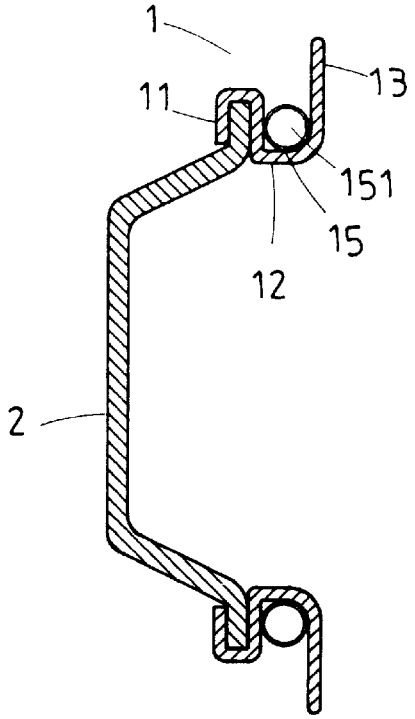
FIG. 6 is a sectional view similar to FIG. 3, illustrating a modified embodiment of the padding device.

FIG. 6 shows an embodiment modified from the first embodiment, wherein the protective plastic ring (now designated by "15") is hollow and includes an interior 151 for filling gas or fluid so as to have an appropriate internal pressure in the plastic ring 15, thereby providing improved wearing comfort.

Figure 7:
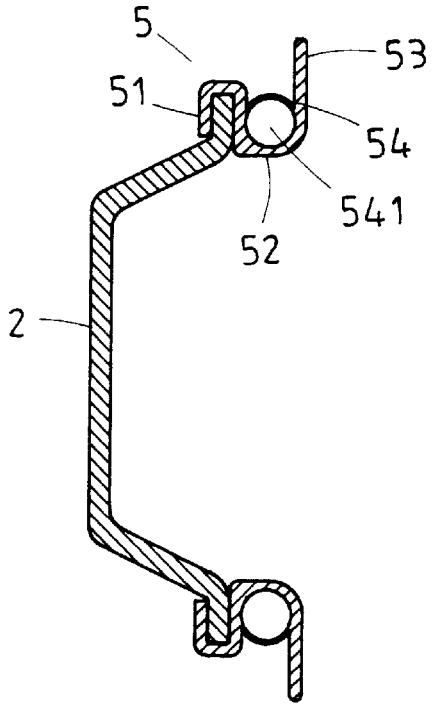
FIG. 7 is a sectional view of another embodiment of the padding device in accordance with the present invention.
Figure 8:
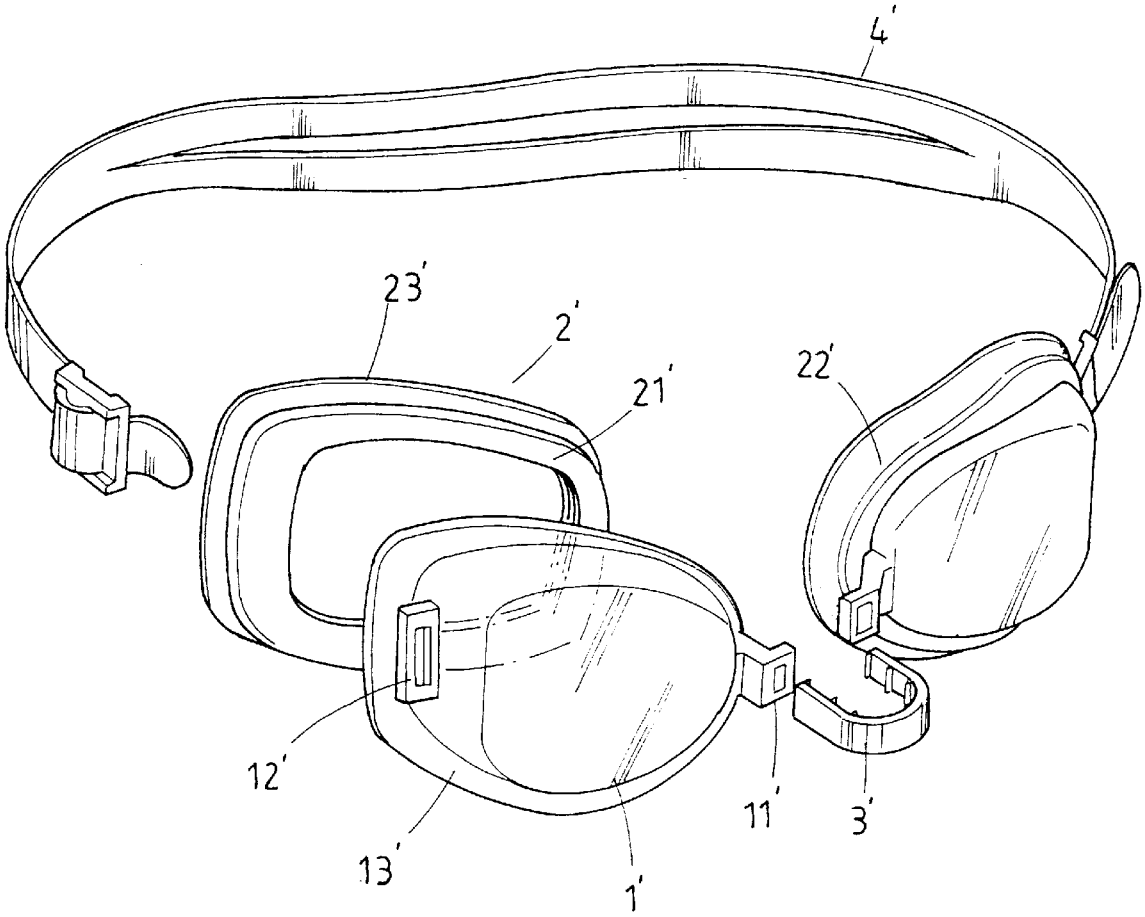
FIG. 8 is a perspective view, partly exploded, of a pair of swimming goggles according to prior art.
Figure 9:
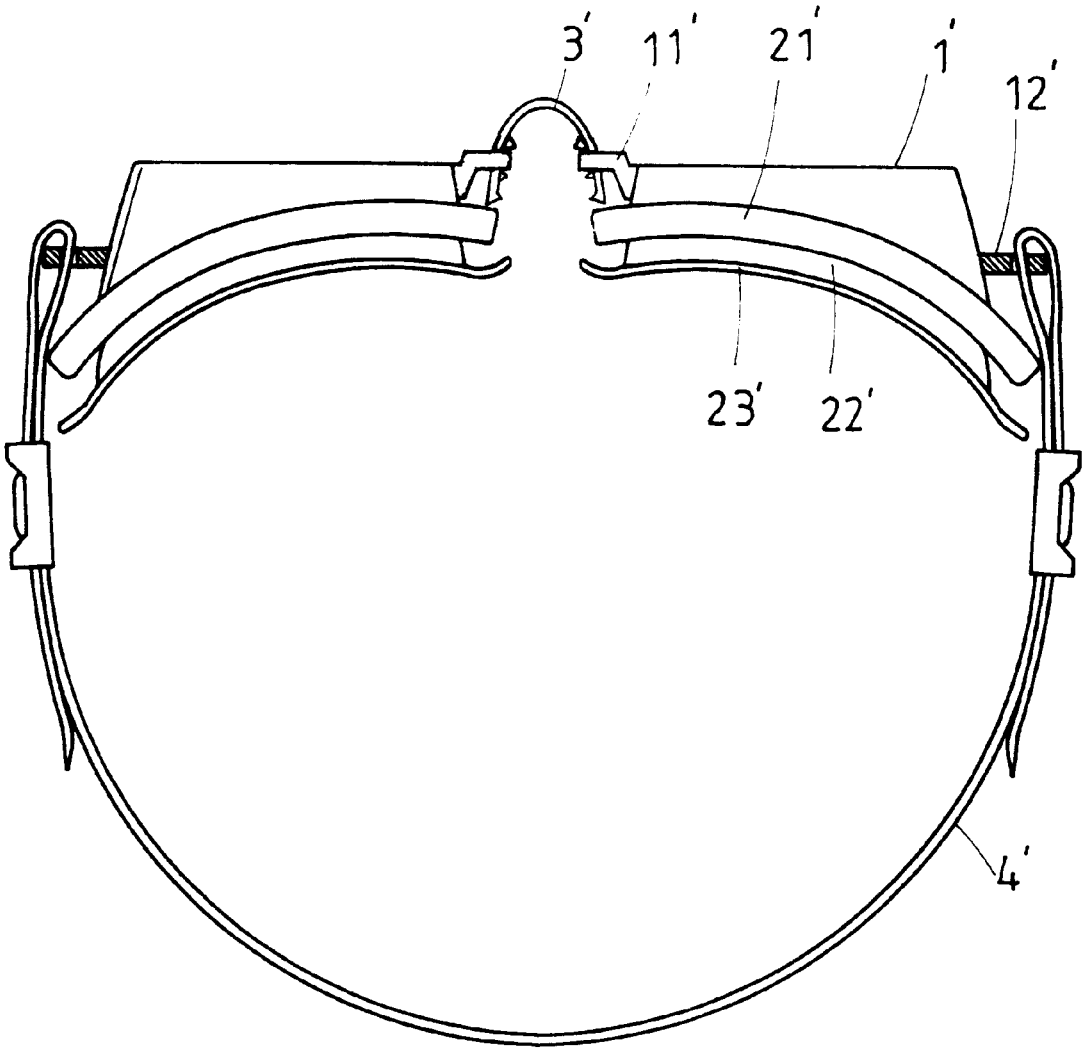
FIG. 9 PRIOR ART
FIG. 9 is a top view of the pair of swimming goggles in FIG. 8.
Figure 10:
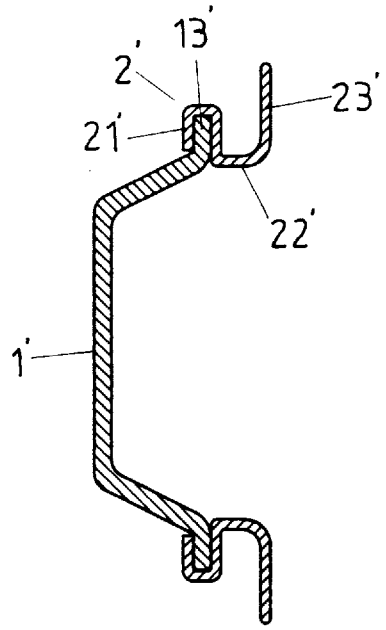
FIG. 10 PRIOR ART
FIG. 10 is a sectional view of the pair of swimming goggles in FIG. 8.
Figure 11:
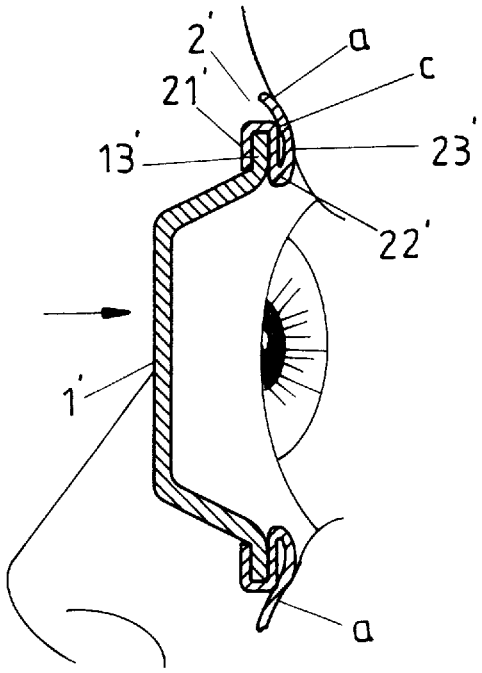
FIG. 11 PRIOR ART
FIG. 11 is a schematic sectional view similar to FIG. 10, illustrating use of the pair of swimming goggles in FIG. 8.
Figure 12:
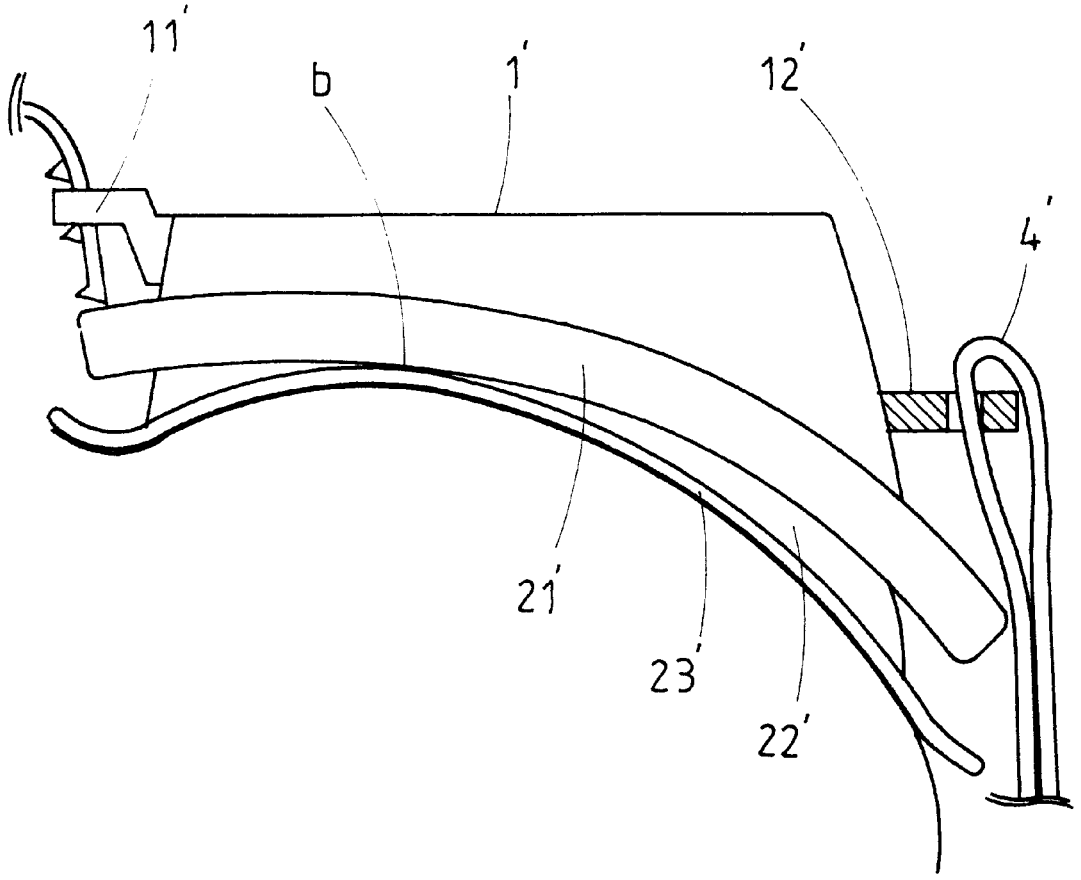
FIG. 12 PRIOR ART
FIG. 12 is an enlarged partial top view of the pair of the swimming goggle in FIG. 8.

FIG. 7 shows a further embodiment of the invention. The padding device (now designated by "5") includes a connecting portion 51 for receiving the lens 2. The padding device 5 includes an elastic annular extension 52 extends inwardly from an inner wall of the connecting portion 51 and then extends upwardly to form a flange 53 that provides a close contact with an eye socket of the user. An annular arcuate section 54 extends between the inner wall of the connecting portion 51 and the flange 53 and thus forms a closed annular space 541 among the inner wall of the connecting portion 51, the extension 52, the flange 53, and the annular arcuate section 54. Gas or fluid may be filled into the closed annular space 541 so as to have an appropriate internal pressure in the closed space 541, thereby providing improved wearing comfort.

According to the above description, it is appreciated that the padding devices in accordance with the present invention may provide improved wearing comfort and watertight effect regardless of the contour of the eye socket of the user. The rigid end edge of the lens is not directly contacted with the flange of the padding device due to provision of the plastic protective ring. In addition, the padding device with gas or fluid filled therein may have buoyancy such that the pair of swimming goggles may float on the water to thereby avoid loss of the pair of swimming goggles.

Although the invention has been explained in relation to its preferred embodiment, it is to be understood that many other possible modifications and variations can be made without departing from the spirit and scope of the invention as hereinafter claimed.

What is claimed is:

1. A padding device for a pair of swimming goggles, the padding device comprising:

a connecting portion adapted to be connected to a lens of the pair of the swimming goggles, the connecting portion including an inner wall;

an elastic annular extension extended inwardly from the inner wall of the connecting portion;

a flange extended from the elastic annular extension to thereby define an annular groove between the inner wall of the connecting portion, the annular extension, and the flange, the flange being adapted to be in a close contact with an eye socket of a user; and a plastic protective ring received in the annular groove for preventing the flange from being contacted with a rigid portion of the pair of swimming goggles.

2. The padding device as claimed in claim 1, wherein the plastic protective ring is solid.

3. The padding device as claimed in claim 1, wherein the plastic protective ring is made of foam material.

4. The padding device as claimed in claim 1, wherein the plastic protective ring is hollow and filled with gas.

5. The padding device as claimed in claim 1, wherein the plastic protective ring is hollow and filled with fluid.

6. A padding device for a pair of swimming goggles in combination with a goggle frame with an inner wall, the padding device comprising:

an elastic annular extension extended inwardly from the inner wall of the goggle frame;

a flange extended from the elastic annular extension to thereby define an annular groove between the inner wall of the goggle frame, the annular extension, and the flange; and a plastic protective ring received in the annular groove for preventing the flange from being contacted with a rigid portion of the pair of swimming goggles.

7. The padding device as claimed in claim 6, wherein the plastic protective ring is solid.

8. The padding device as claimed in claim 6, wherein the plastic protective ring is made of foam material.

9. The padding device as claimed in claim 6, wherein the plastic protective ring is hollow and filled with gas.

10. The padding device as claimed in claim 6, wherein the plastic protective ring is hollow and filled with fluid.

11. A padding device for a pair of swimming goggles, the padding device comprising:

a connecting portion adapted to be connected to a lens of the pair of the swimming goggles, the connecting portion including an inner wall;

an elastic annular extension extended inwardly from the inner wall of the connecting portion;

a flange extended from the elastic annular extension, the flange being adapted to be in a close contact with an eye socket of a user; and an annular arcuate section extended between the inner wall of the connecting portion and the flange to thereby define a closed annular space among the inner wall of the connecting portion, the annular extension, the flange, and the annular arcuate section.

12. The padding device as claimed in claim 11, wherein the closed annular space is filled with gas.

13. The padding device as claimed in claim 11, wherein the closed annular space is filled with fluid.

* * * * *